US007123122B2

(12) United States Patent
Pohl et al.

(10) Patent No.: US 7,123,122 B2
(45) Date of Patent: Oct. 17, 2006

(54) CENTER TAPPED CHIP INDUCTOR

(75) Inventors: John R. Pohl, Chandler, AZ (US); Gregory J. Haubrich, Champlin, MN (US); B. Kendall Berg, Glendale, AZ (US)

(73) Assignee: Medtronic, Inc., Minneapolis, MN (US)

( * ) Notice: Subject to any disclaimer, the term of this patent is extended or adjusted under 35 U.S.C. 154(b) by 35 days.

(21) Appl. No.: 10/793,577

(22) Filed: Mar. 4, 2004

(65) Prior Publication Data

US 2004/0233029 A1 Nov. 25, 2004

(51) Int. Cl.
*H01F 27/29* (2006.01)

(52) U.S. Cl. ..... 336/192

(58) Field of Classification Search ..... 336/65, 336/83, 192, 198, 200, 232
See application file for complete search history.

(56) References Cited

U.S. PATENT DOCUMENTS

| | | | | |
|---|---|---|---|---|
| 5,572,180 | A | 11/1996 | Huang et al. | 336/200 |
| 5,892,425 | A | 4/1999 | Kuhn et al. | 336/200 |
| 5,923,237 | A * | 7/1999 | Sato et al. | 336/212 |
| 5,936,504 | A * | 8/1999 | Hatakenaka | 336/200 |
| 6,159,817 | A | 12/2000 | Altimari et al. | 438/381 |
| 6,249,203 | B1 | 6/2001 | Hanato et al. | 336/185 |
| 6,377,151 | B1 | 4/2002 | Takayama et al. | 336/83 |
| 6,825,748 | B1 * | 11/2004 | Ibata et al. | 336/200 |
| 2002/0013134 | A1 | 1/2002 | Castillejo et al. | 455/140 |

FOREIGN PATENT DOCUMENTS

| | | | |
|---|---|---|---|
| JP | 58-080807 | * | 5/1983 |
| JP | 62-273706 | * | 11/1987 |
| JP | 63-014410 | * | 1/1988 |
| JP | 01-181403 | * | 7/1989 |
| JP | 10189343 | | 7/1998 |

* cited by examiner

*Primary Examiner*—Tuyen T Nguyen
(74) *Attorney, Agent, or Firm*—Daniel G. Chapik; Girmalwolde-Michael; Carol F. Barry

(57) ABSTRACT

A center tapped chip inductor includes a core and a winding formed from one or more wires wrapped about the core. A first and a second end terminal are provided along with a medially disposed center terminal, all of which are in electrical contact the winding. By providing a center tap on a chip inductor, a high Q component can be produced while retaining the spatial limitations of a two terminal chip inductor.

9 Claims, 4 Drawing Sheets

Fig 3
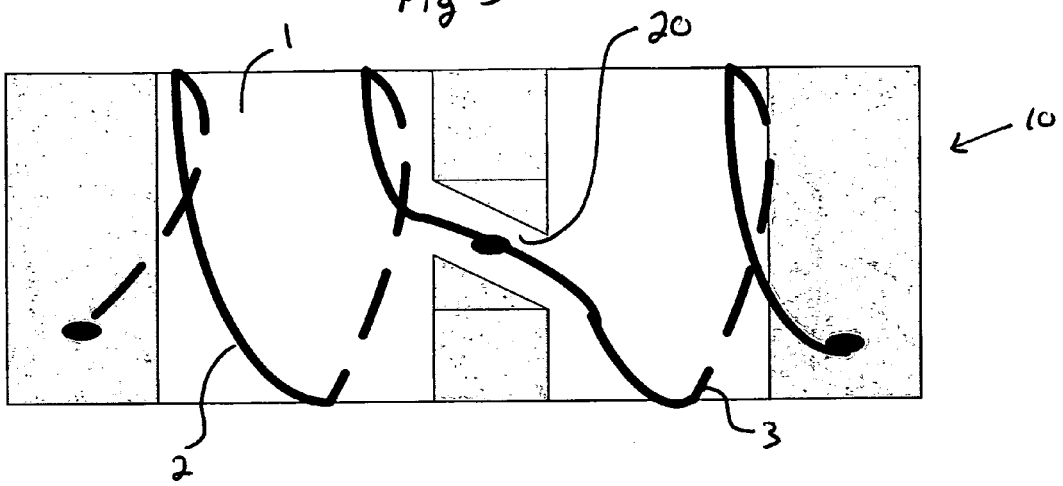
Fig 4
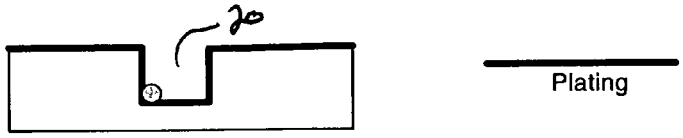
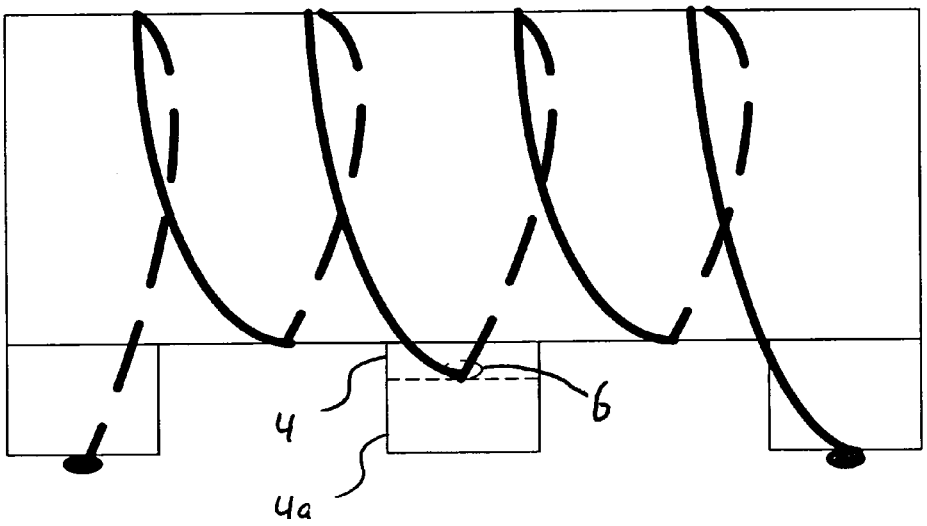
Fig. 5

CENTER TAPPED CHIP INDUCTOR

FIELD OF THE INVENTION

The present invention relates generally to electrical components. More specifically, the present invention relates to surface mounted chip components useful in a medical device.

DESCRIPTION OF THE RELATED ART

Chip inductors are useful or desirable in various microelectronic circuits because of their small size and the ability to use pick and place manufacturing techniques for fabrication. Chip inductors will generally include an appropriate non-ferromagnetic core (e.g., ceramic) wrapped with a suitable winding. Two contact terminals are provided, each coupled with an end of the winding.

Such conventional chip inductors generally have a reduced quality factor (Q) as compared with an air coil, because of the mechanical constraints that may be commonly encountered during the manufacturing process. Often, this may be seen as an acceptable engineering tradeoff when the space constraints outweigh the required performance characteristics. In certain circumstances, a center tap may be required in order to introduce a DC voltage at RF ground for tuning purposes or to allow for an impedance transformation between two coils. In such a situation, two chip inductors are utilized, thereby doubling the overall spatial requirements.

As such, there exists a need to provide an improved chip inductor. Furthermore, there exists a need to provide an improved chip inductor that minimizes the amount of spaced required.

BRIEF DESCRIPTION OF THE DRAWINGS

FIG. 3 is a schematic illustration of a second embodiment of a center tap chip inductor having a channel bored through a portion of the substrate to facilitate the guidance and winding of the coil.

FIG. 4 is a schematic, side sectional view of a portion of the substrate illustrating the channel.

FIG. 5 is a third embodiment of a center tapped chip inductor having a center tap terminal.

DETAILED DESCRIPTION

Figure 1:
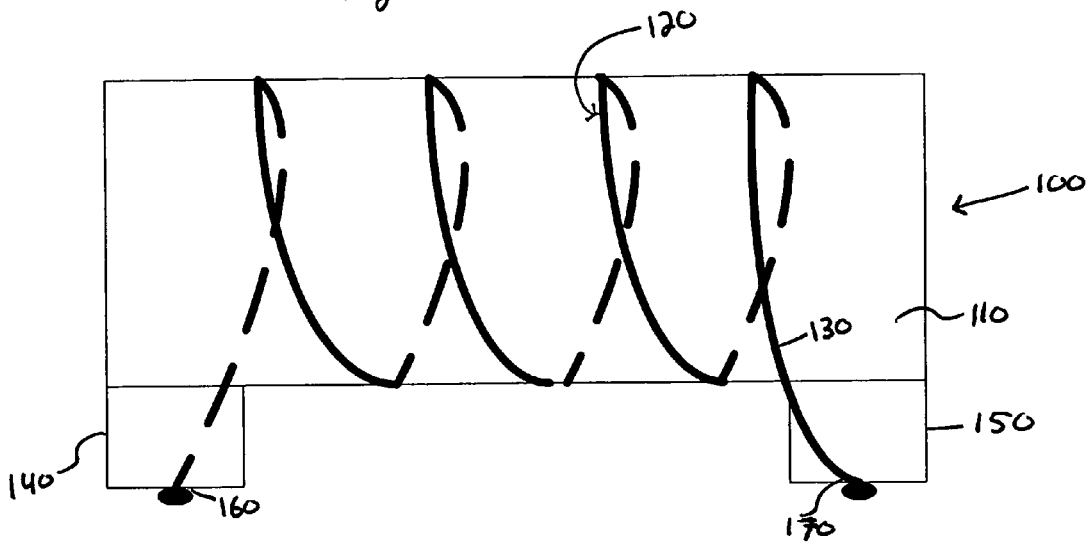
FIG. 1 is a schematic illustration of a conventional chip inductor.

FIG. 1 illustrates a conventional chip inductor 100 having a non-ferromagnetic substrate forming a core 110. A winding 120 is formed from one or more wires 130 that are wrapped about the core 110. A first contact 140 and a second contact 150 are disposed on opposing ends of the core 110. A first end 160 of the winding 120 is coupled with the first contact 140 and a second end 170 of the winding 120 is coupled with the second contact 150. Thus, a conventional two terminal chip inductor 100 is provided that can be surface mounted to and electrically coupled with a microelectronic circuit.

Figure 2:
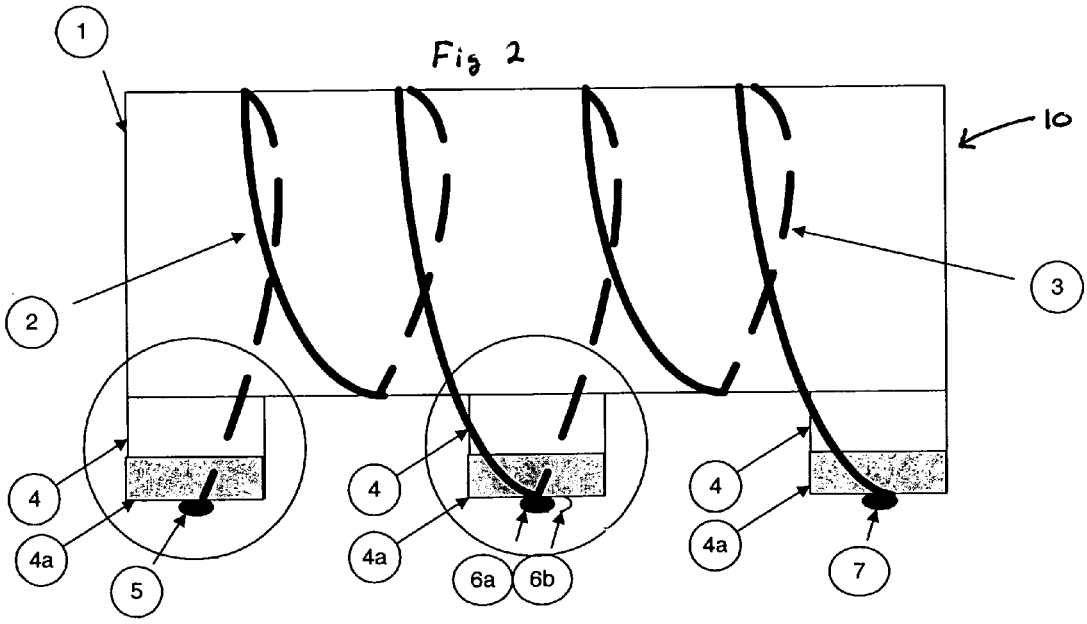
FIG. 2 is a schematic illustration of a first embodiment of a center tap chip inductor having a winding formed from two wires that converge on a center tap pad.

FIG. 2 is a schematic illustration of a first embodiment of a center tap chip inductor 10. Chip inductor 10 includes a core 1 that may be a non-ferromagnetic (e.g., ceramic). A winding is wrapped about the core 1. The winding is formed, in this embodiment, from two separate wires 2, 3 having an appropriate diameter. Attached to the core 1 are a series of terminals or contacts 5, 6, and 7, each having a base 4 and a metal contact pad 4*a* to provide good electrical contact. There is a contact 5, 7 provided at each end of the core 1 as well as a center contact 6, medially disposed along the core 1.

The first wire 2 is wrapped about the core 1 and is coupled between the first contact 5 and the center contact 6. Similarly, the second wire 3 is wrapped about the core 1 and is coupled between the second contact 7 and the center contact 6. More specifically, as two wires 2, 3 are used in this embodiment, center contact 6 may include a separate contact point 6*a*, 6*b* for each such wire allowing for ease of attachment as well as assuring electrical contact.

The number of windings employed between contacts will vary, based on the desired inductance ratio. If center contact 6 is to act as a true "center tap", then the number of windings on either side thereof should be the same. Various other results can be achieved by offsetting the medial terminal as desired.

Thus, the center contact 6 provides a center tap for the chip inductor 10. This allows a DC voltage to be applied at RF ground, provides an appropriately small component for use in microelectronic circuits, provides a surface mountable component, and maintains the same high Q level of a two terminal chip inductor. The center tapped chip inductor 10 is well suited for use in implantable medical devices, particularly implantable medical devices that use or require RF telemetry. Of course, such a device has wide applicability to other electronic circuits, including various radio transceiver devices.

FIGS. 3–5 illustrate a second embodiment of the center tap chip inductor 10. In this embodiment, a deformity, a passageway, a guide or equivalent structure is provided as represented by an exemplary channel 20 that is provided within the substrate or core 1. The channel 20 is provided to align the wire(s) 2, 3 with respect to the core 1 and the various terminals 5, 6, and 7. This embodiment also illustrates how the core 1 or portions thereof may be plated. For center tap 6, the contact between the wire 2, 3 and the terminal 4 is made to the top (as illustrated) of the contact pad 4*a*, rather than the bottom as previously illustrated.

Channel 20 may have any desired cross-sectional configuration, including, for example, rectilinear, circular, semicircular/castellation, elliptical, angular, curvilinear, or otherwise. As illustrated, channel 20 is disposed at a non-perpendicular angle with respect to a main axis of the terminal 4. The channel 20 be positioned so as to be perpendicular to or to have any desired angle with respect to the terminal 4.

Figure 6:
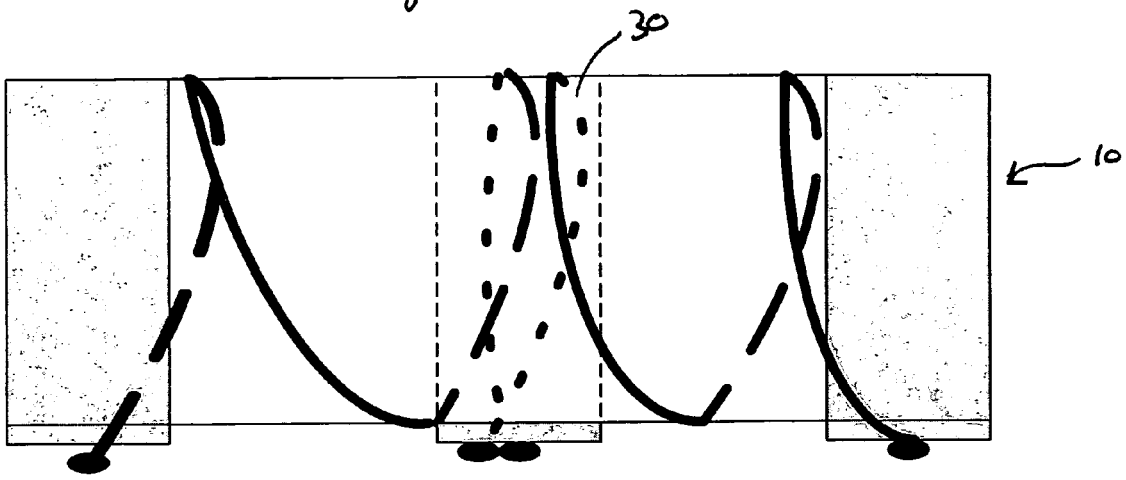
FIG. 6 is a fourth embodiment of a center tapped chip inductor having a medially disposed through bore to align the wire forming the coil with the center tap terminal.

FIG. 6 illustrates a third embodiment of the center tap chip inductor 10. In this embodiment, a through bore 30 is disposed through a portion of the core 1. The through bore 30 facilitates alignment of the wire(s) 2, 3 with the center terminal 6.

Figure 7:
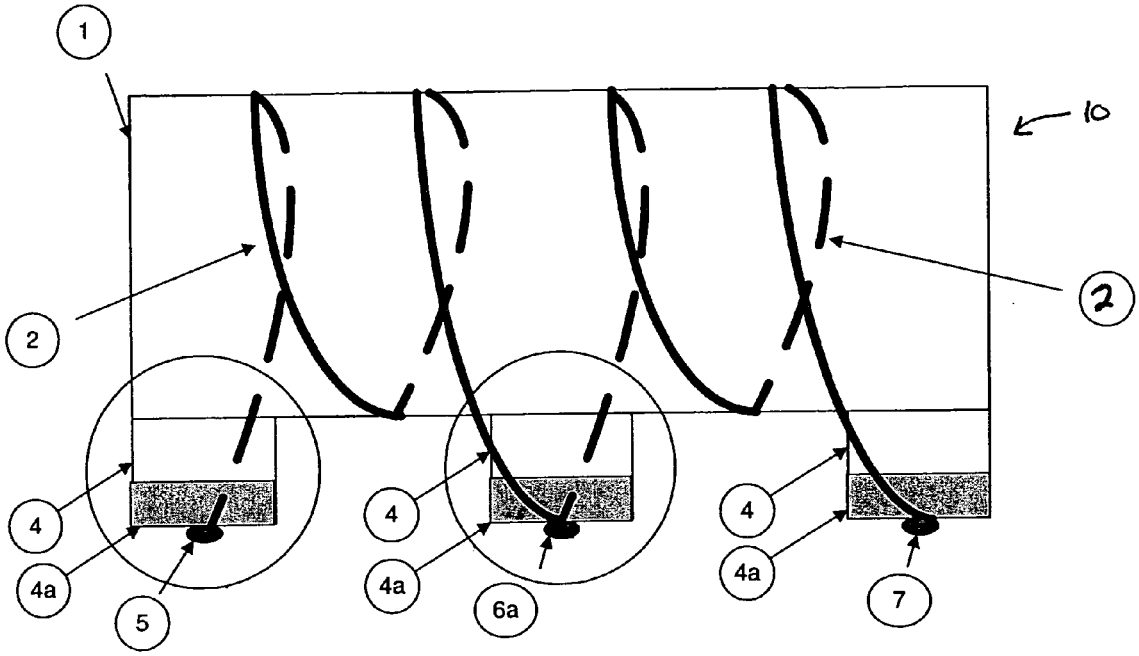
FIG. 7 is a center tapped chip inductor having a single wire forming the winding, wherein the single wire is physically and electrically coupled with the center tap pad.

FIG. 7 illustrates a fourth embodiment of the center tap chip inductor 10. In this embodiment, a single wire 2 is used to form the winding. The wire 2 is wrapped about the core 1 in the known way; however, the wire 2 contacts center terminal 6 forming a center tap.

The invention claimed is:

1. A center tapped chip inductor for an implantable medical device comprising:

a core;

a winding wrapped about the core;

a first and a second terminal in electrical contact with the winding;

a center terminal disposed between the first and the second terminal and in electrical contact with the winding; and a deformity disposed within the core proximate the center terminal, the deformity being conductive and coupled to the center terminal, the deformity guides a portion of the winding to the center terminal.

2. The center tapped chip inductor of claim 1, wherein the winding has an equal number of turns between the first terminal and the center terminal and between center terminal and the second terminal.

3. The center tapped chip inductor of claim 1, wherein the center terminal further comprises:

a base portion coupled with the core; and a contact portion coupled with the base portion, wherein the winding is in electrical contact with the contact portion.

4. The center tapped chip inductor of claim 3, wherein the winding contacts the contact portion at a boundary between the base portion and the contact portion.

5. The center tapped chip inductor of claim 1, wherein the winding includes a first wire and a second wire.

6. The center tapped chip inductor of claim 5, wherein the first wire is wrapped about a first portion of the core with a first end contacting the first terminal and second end contacting the center terminal and the second wire is wrapped about a second portion of the core with a first end contacting the center terminal and a second end contacting the second terminal.

7. The center tapped chip inductor of claim 1, further comprising a through bore disposed through the core in the center terminal so that the winding is guided to the center terminal.

8. A center tapped chip inductor for an implantable medical device comprising:

a core;

a winding wrapped about the core;

a first and a second terminal in electrical contact with the winding;

a center terminal disposed between the first and the second terminal and in electrical contact with the winding;

a base portion coupled with the core;

a contact portion coupled with the base portion, the contact portion being conductive, the winding in electrical contact with the contact portion, wherein the winding contacts the contact portion at a boundary between the base portion and the contact portion.

9. A center tapped chip inductor for an implantable medical device comprising:

a core;

a winding wrapped about the core;

a first and a second terminal in electrical contact with the winding;

a center terminal disposed between the first and the second terminal and in electrical contact with the winding; and a through bore disposed through the core at the center terminal to guide the winding to the center terminal, the through bore being conductive.

* * * * *

UNITED STATES PATENT AND TRADEMARK OFFICE

CERTIFICATE OF CORRECTION

PATENT NO. : 7,123,122 B2
APPLICATION NO. : 10/793577
DATED : March 4, 2004
INVENTOR(S) : Pohl et al.

It is certified that error appears in the above-identified patent and that said Letters Patent is hereby corrected as shown below:

On the Title Page of the patent in (74) Attorneys, please change "Girmalwolde-Michael" to --Girma Wolde-Michael--.

Signed and Sealed this

Ninth Day of October, 2007

JON W. DUDAS
*Director of the United States Patent and Trademark Office*

UNITED STATES PATENT AND TRADEMARK OFFICE

CERTIFICATE OF CORRECTION

PATENT NO. : 7,123,122 B2
APPLICATION NO. : 10/793577
DATED : October 17, 2006
INVENTOR(S) : Pohl et al.

It is certified that error appears in the above-identified patent and that said Letters Patent is hereby corrected as shown below:

On the Title Page of the patent in (74) Attorneys, please change "Girmalwolde-Michael" to --Girma Wolde-Michael--.

This certificate supersedes Certificate of Correction issued October 9, 2007.

Signed and Sealed this

Thirtieth Day of October, 2007

JON W. DUDAS
*Director of the United States Patent and Trademark Office*